US005835329A

United States Patent [19]

Sucholeiki

[11] Patent Number: 5,835,329

[45] Date of Patent: Nov. 10, 1998

[54] APPARATUS FOR AGITATION SEPARATION OF MAGNETIC PARTICLES

[75] Inventor: Irving Sucholeiki, Watertown, Mass.

[73] Assignee: Solid Phase Sciences Corporation, Watertown, Mass.

[21] Appl. No.: 462,198

[22] Filed: Jun. 5, 1995

[51] Int. Cl.[6] ..... H01H 47/22

[52] U.S. Cl. ..... 361/143; 361/167

[58] Field of Search ..... 361/139, 143, 361/146, 147, 167; 366/273; 202/232; 403/DIG. 1; 307/94, 104

[56] References Cited

U.S. PATENT DOCUMENTS

| | | | |
|---|---|---|---|
| 3,970,518 | 7/1976 | Giaever | 435/239 |
| 4,219,411 | 8/1980 | Yen et al. | 209/213 |
| 4,537,850 | 8/1985 | Smeiman | 430/137 |
| 4,752,138 | 6/1988 | Rufer | 366/274 |
| 5,028,142 | 7/1991 | Ostoich et al. | 366/273 |
| 5,040,898 | 8/1991 | Sweatman et al. | 366/273 |
| 5,318,914 | 6/1994 | Matte et al. . | |
| 5,336,760 | 8/1994 | Hardwick et al. . | |

OTHER PUBLICATIONS

Rudolf F. Graf, The Encyclopedia of Electronic Circuits, 1st ed., USA, 1985.

*Primary Examiner*—Fritz Fleming
*Attorney, Agent, or Firm*—Jacob N. Erlich; Jerry Cohen

[57] ABSTRACT

This invention provides a method and apparatus for agitating magnetic particles, suspended in a solvent using an alternating magnetic field gradient. The apparatus has a housing chamber capable of holding one or more vials containing suspended paramagnetic particles, one or more magnetic field generating devices surrounding the housing chamber and a controller device for controlling the length of time and position of the magnetic field generated.

3 Claims, 4 Drawing Sheets

APPARATUS FOR AGITATION SEPARATION OF MAGNETIC PARTICLES

The invention relates to a class of devices for agitating magnetic particles, suspended in a solvent and contained in a suitable container, by means of a varying magnetic field gradient. It also relates to devices for immobilizing magnetic particles in a suspension by means of a magnetic field gradient, thereby permitting the solvent to be drawn out the container. Finally, this invention describes processes to carry out the agitation and separation functions enabled by this class of devices.

BACKGROUND OF THE INVENTION

Solid phase supports have been applied for several years in biological and chemical systems to carry out a broad range of functions. Such supports typically are microsphere particles composed of, for example, organic polymeric resins such as cross linked polystyrene resins or crosslinked polysiloxane resins, or silica beads which may or may not be coated with a bonding resin. These materials are essentially inert or experience benign responses to the conditions under which they are used. The resin or silica particles are usually chemically derivatized by introducing pendant functional groups which serve as the basis for conducting a variety of processes on them.

Solid phase supports have been extensively used in chemical synthesis. Peptide and protein synthesis was among the earliest of applications for such resins, as described by Erickson, B. W., and Merrifield, R. B., in *The Proteins,* 3rd ed., Vol. 2, pp. 105–253, Academic Press, 1977, and is extensively used in manual peptide synthesis and in commercially available automated peptide synthetic apparati. Automated oligonucleotide synthesis, based on silica particles as a support, is also in broad application in molecular biology, genetic engineering, antisense therapeutics, and gene therapy (See Gait, M., *Oligonucleotide Synthesis, A Practical Approach*, IRL Press, 1984). An extensive range of applications of solid supports exists for immunological applications. Antigens and antibodies immobilized on solid particles find application in immunoassays, immunoaffinity isolation procedures, immunological entrapment of cells, fluorescent immunological applications, and many more. Cells may also be bound to solid support particles in other ways, for example by the use of immobilized lectins to mediate the binding; such immobilized cells may then be used in a broad range of further applications.

In recent years solid particles bearing pendant functional groups have also been applied in the synthesis of more generalized classes of organic molecules (see Moos, W. H., Green, G. D., and Pavia, M. R., *Annual Reports in Medicinal Chemistry,* 28, 315, 1993). The applications of such chemical substances are wide and varied. They may serve as intermediates in the synthesis of yet more complex materials. Solid particles may be applied in scale-up to prepare larger amounts of a desired compound. They may serve as ligands, inhibitors or substrates in various applications in in vitro diagnostic assays or analogous procedures. And most significantly, they may be applied in the preparation of new pharmaceutical compounds having therapeutic use. In the latter case, synthesis on solid supports affords the ability to prepare a known or identified pharmaceutical agent.

The process of synthesizing new compounds on solid supports is also being applied in drug discovery. It is important to be able to construct large collections of homologous compounds in the search for new pharmaceutical agents, in which various moieties of a general framework structure are systematically varied, thereby generating many permutations of possible structures. This approach has been termed combinatorial synthesis, and the collections of products obtained by such processes are called libraries. It is necessary in the creation of libraries to keep the various members of the population segregated. Thus there is a need for a physical system which can manipulate replicate synthetic processes in several parallel containers.

Similarly, construction of libraries is possible in peptide synthesis, wherein different amino acid residues are introduced at a particular position in the sequence, instead of a defined single residue. This process would create a library of oligopeptides instead of a single entity with a defined sequence. An analogous approach may also be used in the synthesis of oligonucleotides, generating libraries with differing base sequences.

Many applications in drug discovery, or in diagnostic procedures, seek to search populations of candidate molecules, such as those that are created in combinatorial synthesis, for those members of the population having a desired activity. It is convenient to adapt this screening to solid-supported processes. Thus, in such applications there is a requirement for the physical segregation of replicate probing reactions run in parallel.

To conduct reactions or assays involving solid particles, the particles are contained in a vessel suspended in a solvent, the solvent commonly containing dissolved reagents. There are several ways available for separating the particles from the solvent, when appropriate, in order to terminate a reaction or process, or to rid the particles of side products, or simply to rinse them between steps of the process. First, the suspension may be filtered, if the container or vessel contains a floor composed of a suitable filter disc. Second, centrifugation may be used if the particles have a different density than the solvent in which they are suspended. Finally the advent of magnetic particles has made separation by magnetic means a feasible procedure.

Magnetic particles typically are composite particles with a core of a paramagnetic or superparamagnetic substance, enclosed in a shell such as a polymer resin or a silica shell; in other examples the particles of the paramagnetic material themselves are simply coated with a lipid or a mono- or paucimolecular layer of a protective coating. Such particles are readily drawn toward the source of a magnetic field gradient, such as a permanent magnet or an electromagnet. In such a procedure the particles are segregated to the wall closest to the aforementioned source, leaving the remainder of the vessel available for withdrawing the solvent by a process, for example, of aspiration. In one such application, antigen complexed to magnetic particles was used to obtain a specific antibody from physiological fluids in an apparatus incorporating a static magnetic field gradient (Hardwick, R. A., Smith, A. K., Lake, W., C and Chenoweth, D. E., U.S. Pat. No. 5,336,760). J. Vorpahl described a method for moving a component of interest, bound to magnetic particles, from one liquid phase into a second, contiguous liquid phase (U.S. Pat. No. 5,279,936). Magnetic particles have used in the immunological analysis of antigens by using a static magnetic field to induce antibody-coated magnetic particles to bind the walls of a vessel, then varying the field to induce those particles not bound to fall to the bottom of the vessel (Matte, C., and Muller, A., U.S. Pat. No. 5,318,914). A variant procedure was described by A. Bose and S. V. Sonti (U.S. Pat. No. 5,248,589), wherein a ferrofluid of magnetic nanoparticles mediates the separation of ferritin bound to an antibody, itself complexed to an antigen, by means of steel wool. The use of magnetic field gradients, however, has to date not been systematically applied to remove solvent from a suspension of magnetic particles, and in particular has not been implemented for solvent removal in replicate synthetic processes conducted in parallel vessels.

Agitation of solid supports in synthetic and assay applications is also needed. A common approach is simple movement, such as rocking, to agitate or invert the suspension in the vessel. Stirring by means of mechanical mixing is possible, but has the disadvantage of tending to abrade the particles upon extended or repetitive use. Achieving agitation of replicate synthetic or assay processes in parallel vessels, such as would be done in working with a combinatorial library, is particularly challenging. Use of magnetic particles would have the advantage that they may be gently manipulated within the vessel containing the suspension of the particles by means of magnetic field gradients imposed from without the vessel, thereby diminishing the shear gradients that lead to particle abrasion. Such a procedure would also have fewer moving parts, thus limiting the degree of mechanical intervention on any apparatus used.

BRIEF SUMMARY OF THE INVENTION

This invention provides means for manipulating magnetic particles, intended for use in processes such as chemical synthesis, diagnostic assays, immobilization or reactions of cells, and the like, suspended in a solvent, the suspension contained in a suitable vessel, by the use of magnetic field gradients imposed externally to the vessel. It further provides a means for continually agitating the solid particles of the suspension by applying several magnetic field gradients, oriented differently about the vessel and activated at differing times, thus drawing the particles alternately toward different sources of the magnetic field gradients. In another aspect of the invention, a static magnetic field gradient is applied to immobilize the magnetic particles against a particular surface of the containing vessel, thereby permitting the solvent to be drawn off.

In other embodiments of the invention a means is provided for the simultaneous agitation of magnetic particles in several suspensions, contained in several vessels arrayed on a horizontal planar surface, by the use of several sets of magnetic field gradients. The various sets are oriented differently about the horizontal array, and are activated at differing times, thus drawing the particles suspended in each vessel alternately toward different sources of the magnetic field gradients having different orientations. The present invention further provides a set of static magnetic field gradients to immobilize magnetic particles in several suspensions, contained in several vessels arrayed on a horizontal planar surface, against a particular surface of the containing vessels, thereby permitting the solvent to be drawn off from each vessel.

The invention furthermore provides a process for the continual agitation of magnetic particles, contained in at least one suspension in a solvent within at least one vessel, by applying magnetic field gradients oriented differently about the vessel or vessels and activating magnetic field gradients at differing times. And finally this invention provides a process for using static magnetic field gradients in order to immobilize magnetic particles, which had been in at least one suspension in a solvent and contained in at least one vessel, against a particular surface of the containing vessel or vessels, thereby permitting the solvent to be drawn off from the vessel or vessels.

DETAILED DESCRIPTION OF THE INVENTION

Figure 1:
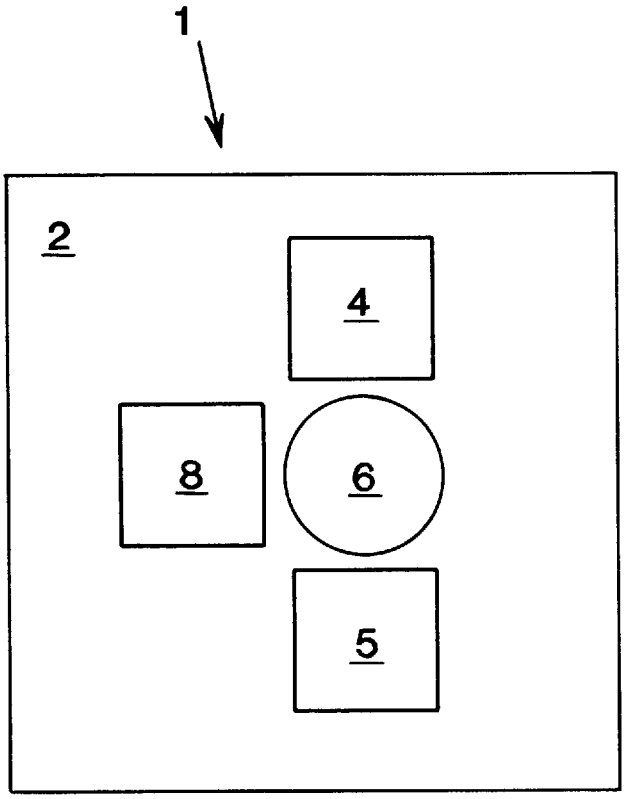
FIG. 1 is a plan view of an embodiment of the invention incorporating both alternating and static sources of magnetic field gradients, arrayed about an active region.

This invention presents a class of devices for agitating magnetic particles, in suspension in a solvent, the suspension contained in a suitable vessel, by the imposition of several magnetic field gradients that are oriented in different directions about the vessel. It also describes processes for achieving agitation in such suspensions by application of the devices of the invention. Each one of the magnetic field gradients is alternately activated at different times, such that the magnetic particles are alternately attracted by and migrate toward different directions in the vessel. In this way the suspension is gently agitated with minimal shear stress on the particles or turbulence in the suspension.

The magnetic particles on which the devices and processes of this invention act may have a variety of compositions. Their crucial attribute is that they have within them particles of paramagnetic or superparamagnetic material which are responsive to the imposition of magnetic field gradients. Examples of paramagnetic or superparamagnetic materials include ferric magnetite, and magnetites of other transition metals. Typically the magnetic particles on which the invention acts will be constructed to contain a core composed of the magnetic material, and a shell or outer layer of resin, silica or some other material adapted for the purpose to which the particles are to be applied.

One embodiment of the invention comprises a device for agitating magnetic particles in suspension in a single diamagnetic vessel by alternately imposing magnetic field gradients, selected one at a time from a plurality of magnetic field gradients. All the devices of this invention include a base. In the present embodiment the vessel containing a suspension of magnetic particles is placed above a particular point on the base. Thus the suspension occupies a region of space above this point termed the active region. The sources of the magnetic field gradients are disposed about the active region, such that the active region is subjected to the magnetic field gradient from each source. Viewed in plan projection, each magnetic field gradient originates from a particular source and hence is oriented, with reference to a coordinate axis which may be defined in the base, in a particular angular orientation. The various sources of the magnetic field gradients are oriented in differing orientations with respect to this axis. A means is provided for causing the alternation in time among the sources of the magnetic field gradients, such that only one is imposing its gradient on the active region at a time, or, if more than one, one dominates over the others at a given time. In this way the active region is subjected to magnetic field gradients having differing orientations, with respect to the coordinate axis, at differing times.

There are two possible sources of the magnetic field gradients that may be applied in the devices of this invention. First, electromagnets may be used; second, permanent magnets may be employed. In those embodiments in which electromagnets are used, the means for causing alternation among the various electromagnets of the set disposed about the active region is electronic. One of a variety of well known circuits may be applied to bring about the alternation; alternatively, a computer-driven analog device may activate the various sources of the set, as is also well known. Other embodiments of the invention employ permanent magnets. Without wishing to limit the scope of the invention, examples of said permanent magnets include alnico alloy, ceramic 5, samarium cobalt alloy and neodymium alloy.

In general, the sources of magnetic field gradients may be disposed about the active region in an unrestricted way. They may be adjacent (essentially coplanar to) the active region, as well as being disposed above, below or about the active region. In a preferred embodiment, electromagnets serving as sources are mounted on the base, so that the sources are essentially coplanar with a section through the active region, with the plane in question being parallel to the base. In other preferred embodiments, at least two permanent magnets are fixedly mounted on a plurality of supports which are caused to move by a reciprocating mechanism. The motion of the supports is such that, depending on the phases between the positions of the various magnets, only one magnet from among the set is closest to the active region. In this way the magnetic field gradient emanating from different magnets exert the strongest effect on the active region at various times. Again, in general, the trajectories of these permanent magnets may traverse any region of space about the active region. In a preferred embodiment, the permanent magnets move approximately in a plane that is parallel to the base and contains a section through the active region.

When a vessel containing a suspension of magnetic particles is placed in the active region and the alternation of the magnetic field gradients is set into operation, the magnetic particles are attracted alternately to each of the activated sources, and migrate toward the particular source that is activated. In the cases when the solvent is a solution containing reagents, ligands or similar reactants, the convective movement of the particles will theoretically have the effect of bringing each particle into a region of the solvent that has a relatively high concentration of reagents, ligands or similar reactants, i.e., one that has not been depleted by previous reaction. In addition, this movement has the effect of inducing convective mixing of the overall suspension. Likewise, in the cases when the solvent is applied as a rinse or wash, the convective movement of the particles will, in theory, have the effect of bringing the particles into a region of the solvent that is relatively fresh, so that side products, excess reactants, and the like may be rinsed away from the particles. Again, the motion of the particles will induce convective mixing of the overall suspension. The agitation induced by the devices of this invention causes minimal erosion of the particles by abrasion, since no contact is made between the particles and any mechanical source of shear. Because of the mixing that occurs in this way the reaction or process will proceed to an extent far greater than would occur by passive diffusion alone, i. e., in the absence of any agitation.

In a further embodiment of the invention, magnetic particles suspended within a vessel contained in the active region may be sequestered by the imposition of a static magnetic field gradient. Under these conditions, all the particles migrate toward the source, and remain fixed in the region of the suspension adjacent a wall of the vessel closest to the source of the magnetic field gradient. This immobilization of the particles permits removal of the solvent to be carried out, for example by aspiration. This is obligatory at the end of each cycle of reaction with a reagent, ligand or similar reactant, in order to terminate the process under way; it is also needed in each rinse or wash.

A preferred implementation of the present invention provides a means for agitating several suspensions of magnetic particles, contained in several vessels arrayed on a horizontal planar surface. Suitable vessels are diamagnetic, and may be vials or test tubes, or they may be the wells in a multiwell plate. Multiwell plates are available commercially and are well known in the art. Materials used to array the vessels are diamagnetic. When a set of several vessels is arrayed on a horizontal planar surface, the active region is a region of space comprehending all the suspensions contained within all the vessels of the set, as well as interstitial regions between any two vessels of the set. A reference set of orthogonal axes with an origin near a central portion of the active region may be defined for this case. According to this embodiment of the invention, several sets of sources of magnetic field gradients are arranged in the region of space surrounding the active region, the different sources oriented differently with respect to the reference axes defined in the active region. In general, the sources may be electromagnets or permanent magnets. If the sources are electromagnets, they may be disposed in fixed positions about the active region approximately coplanar with it, and/or they may be situated above or below the active region. Means are provided for alternately activating various sets of sources at differing times, alternately imposing magnetic field gradients oriented in different directions, with respect to the reference axes, upon the active region. For example, such means may be suitable electronic circuits, or they may be computer-activated analog sources of current. The magnetic field gradients are sufficiently intense, and/or are situated in such a way, as to cause the magnetic particles suspended in each vial, test tube or well to migrate through the solvent toward the source of the gradient. Alternation of the sets of sources of the gradients imposes magnetic field gradients in differing orientations with respect to the reference axes at different times, such that the magnetic particles are attracted alternately toward the different sources.

Alternatively, sets of sources of magnetic field gradients which are continuously activated may be caused to move about the active region. In this embodiment, the array of diamagnetic vessels is fixedly mounted with respect to the base using diamagnetic materials. In order to impose alternating magnetic field gradients on the active region, sets of sources are fixedly mounted on a moveable support. Means are provided for mechanically moving the moveable support in regions of space about the active region. Such motion brings the sources into a plane approximately coplanar with the active region, and/or above the active region, and/or beneath the active region. The sources to be used in this embodiment may be electromagnets or permanent magnets. Alternately moving the sets of sources about the active region alternately imposes magnetic field gradients on each vessel in the active region that differ in their orientation with respect to the reference axes, at different times. In this way the magnetic particles suspended in each vessel are alternately drawn in one direction or another, as the various sources pass close to the respective vessel.

In an additional embodiment relating to several diamagnetic vessels arrayed in the active region, each vessel containing a suspension of magnetic particles, the sources of magnetic field gradients are fixedly mounted on the base and activated continuously. Each set of sources of magnetic field gradients is imposed in a different orientation with respect to reference axes in the active region. Alternate imposition of magnetic field gradients upon each vessel, such as a vial, a test tube or a well in a multiwell plate, is accomplished by having the vessels arrayed on a moveable plate or platform composed of a diamagnetic material. The plate or platform is caused to move in such a way as to bring the active region into magnetic field gradients from different sets of sources at differing times. In this way the suspension in each vessel alternately experiences magnetic field gradients oriented in different directions with respect to the reference axes, inducing the magnetic particles suspended therein to migrate alternately in the respective different directions.

In yet a further implementation of an aspect of this invention, a static magnetic field gradient of equivalent or similar intensity is imposed upon each vial, test tube or well in the array in order simultaneously to immobilize the magnetic particles suspended in each vessel. Sources of intense static magnetic field gradients are fixedly mounted on a moveable support. Means are provided mechanically to bring the moveable support into close proximity with each vessel in the array. The intensity of the sources is sufficiently great to immobilize the magnetic particles within each vessel on a wall of the vessel closest to the sources of the magnetic field gradients. Under these conditions, means may be introduced into each vessel to aspirate the solvent from the vessels. It would be in accord with the objectives implicit in the use of arrays of vessels, namely, conducting multiple reactions, syntheses, or comparable processes simultaneously, to have an apparatus available for simultaneously aspirating the solvent from several or all of the vessels of the array. In this embodiment of the invention, the static magnetic field gradients are of sufficient intensity to sequester the magnetic particles to the walls of each vessel to prevent the entrainment of any of the particles by the aspiration apparatus, despite the possibility that the aspirating means may be inserted into the vessel very close to the site at which the particles are sequestered. In this way no magnetic particles are lost by removal with the solvent.

The devices of this invention are used in processes of agitation of magnetic particles, and in processes of immobilizing magnetic particles adjacent the wall of a vessel. The devices act on suspensions of magnetic particles in suitable solvents, contained in vessels fabricated from a diamagnetic material or substance. In those embodiments in which the active region is a horizontal planar surface, intended to accommodate several vessels, including the wells in a multiwell plate, small amounts of suspension may be used in each vessel. A particularly favorable aspect of the invention, viewed with respect to the synthesis and the assay of members of a combinatorial library, is the possibility of working with as little as a single magnetic particle in a particular suspension. Single particles are difficult to manipulate without incurring a significant risk of loss. Agitation and separation of a single magnetic particle by a magnetic field gradient, however, offers optimal ease and consistency. Thus in common use, the suspensions may contain from a single particle (SP) up to 0.5 g particles/mL, i. e., from SP to 50% (a content of 0.01 g particles/mL is designated 1%). Preferably the suspensions contain from SP to 10% particles.

For the case of a device fabricated to contain a single vessel in the active region, the vessel containing the suspension is placed in the active region of the device. The device is activated by a suitable means, with the result that the sources of magnetic field gradients, disposed in the region of space about the active region, are alternately activated by suitable means included in the device, different sources activated at differing times. As a result of the alternation of the sources of the magnetic field gradients, the magnetic particles in the suspension migrate alternately toward one or another of the sources, as each one is activated. In this way the suspension is agitated, for the particles are drawn into fresh regions of solvent in the suspension, and the collective convective motion of all the particles in the suspension results in mixing of the entire suspension. Without wishing to be constrained by theory, when the solvent of the suspension contain reagents, ligands or similar reactants, a consequence of this mixing is to bring the particles into regions of the solvent that are relatively high in the concentrations of these solutes, and relatively devoid of products and side products of the reaction or process under way. This aids the progress of the reaction or process under way in the vessel. If the solvent is a rinsing or washing solvent, the mixing aids the progress of this step by transporting the particles into fresh regions of solvent, so that depletion of reagents, ligands, similar reactants, soluble products and side products is facilitated.

In a second process of the invention, the devices of this invention are applied to immobilize magnetic particles in suspension for the purpose of separating the particles from the solvent in which they are suspended. This permits the removal of the solvent, by aspiration or other suitable means. The method by which this process is carried out by fixed electromagnets comprises constant activation of only certain ones of the magnets, for an extended interval of time. For sources moveably mounted about the active region, the method comprises stopping the motion of the sources, holding them in a fixed position adjacent the active region. As a consequence of either of these steps, the particles migrate to the wall of the vessel closest to a source, and are sequestered and immobilized at or in the region of the wall of the vessel adjacent the source. This permits a means to be introduced into the vessel for removing the solvent, for example by aspiration, leaving behind the particles immobilized by the magnetic field gradient. The interval of time for which this status is maintained is sufficient for the particles to migrate to the wall and to permit the means used to remove the solvent from the vessel to complete the operation.

Similar methods of use of the devices of this invention are intended for those embodiments in which the active region contains arrays of vessels. The vessels, and the means provided for containing the vessels within the active region, are constructed of diamagnetic materials. The vessels arrayed in the active region may be vials, test tubes, the individual wells of a multiwell plate, or any similar set of containers. Each vessel contains a suspension of magnetic particles in a suitable solvent. Typically, the suspensions contain from SP to 50% particles, and preferably contain from SP to 10% particles. For processes of agitation, the device is set into operation by a suitable means. In certain embodiments of the invention the device comprises sets of sources of magnetic field gradients fixedly arrayed in the region of space surrounding the active region, and the sources are alternately activated by a suitable means included in the device. In other embodiments of the invention the sets of sources of magnetic field gradients are moveably disposed about the active region, with the array containing the vessels fixed with respect to the base. In further embodiments the array containing the vessels is moveably disposed in the active region, and the sources are fixed with respect to the base. In all the embodiments under consideration, activation of the device results in magnetic field gradients alternately being imposed on each vessel contained in the array. As a consequence, the magnetic particles in each vessel migrate alternately toward one source or another. In this way the contents of each vessel are agitated and mixed.

A process for immobilizing the magnetic particles suspended in a solvent is also provided for those embodiments of this invention in which the active region contains an array of vessels. This permits removal of the solvent of the suspension. This is accomplished by activating a single set of sources of magnetic field gradients, in a static fashion, for a given interval of time. In those embodiments of the invention in which the sources of magnetic field gradients are fixedly arrayed about the active region and are activated electronically, only a single set of sources is statically activated. In those embodiments of the invention in which either the sources of the magnetic field gradients are moveably disposed about the active region, or in which the array of vessels is moveably disposed in the active region by a suitable means, the motion of the sources, or the motion of the means of moving the array of vessels, is stopped. Under any of these conditions the particles in each vessel migrate to the wall of the vessel closest to that source or those sources, and are retained and immobilized at or near the wall of the vessel at that position in the vessel. This allows a means to be introduced into each vessel for removing the solvent, for example by aspiration, leaving behind the particles immobilized by the magnetic field gradient. This particular source, or set of sources, of one or several magnetic field gradients is activated for a period of time sufficiently long for the particles to migrate to the wall and to permit the means used to remove the solvent from the vessel to complete the operation. It is most advantageous to aspirate solvent from several vessels simultaneously.

Magnetic particles are now commonly used in a large variety of applications, involving reactions, processes and assay procedures that utilize their advantageous properties. The devices of this invention, and the methods of using said devices, enhance the utility of magnetic particles in these applications by affording a means for mixing the magnetic particles in the suspension used in reaction, process or assay procedure in question. In order to permit ease of manipulation by the magnetic field gradients of the invention, the particles may have diameters of from 50 $\mu$m to 1 mm, preferably from 100 $\mu$m to 500 $\mu$m. The particles comprise compositions that are derivatized by pendant chemical functional groups, such that covalent bonds or noncovalent interactions anchor molecular fragments, moieties or residues to the particles appropriate for the synthetic reaction, the chemical or physical process, or the assay to be readily conducted. Examples of moieties that may be bound covalently or noncovalently include, but are not restricted to, chemical substances serving as intermediates in the synthesis of a final product, the final product of a chemical synthesis, oligopeptides, polypeptides, derivatives or modifications of oligopeptides or polypeptides, oligonucleotides, polynucleotides, derivatives or modifications of oligonucleotides or polynucleotides, proteins, enzymes, immunoglobulins or active fragments thereof, derivatives or modifications of immunoglobulins or active fragments thereof, including immunoglobulins or active fragments thereof conjugated to enzymes, lectins, whole cells, and the like.

The use of arrays of vessels enables simultaneous manipulation of a large number of vials, test tubes or wells. The embodiments of this invention relating to active regions containing arrays of vessels offers the advantages of permitting the magnetic particles, suspended in each vessel, to be simultaneously agitated during the reaction, synthetic step, or comparable process called for by the experimental objective. Thus solid-supported operations leading to libraries of compounds, or to simultaneous assays for identifying compounds contained within a library that has already been synthesized, are facilitated by the devices of this invention. Likewise, the use of static field gradients to immobilize the particles so that simultaneous removal of solvent may take place in several or all vessels also facilitates operations with multiple processes or processes involving libraries.

The devices of the invention may be understood from the following descriptions of working examples and processes. These examples serve to present the principles of the invention. They should not be construed in any way to limit its scope.

EXAMPLE 1

In the electromagnetic mixing device 1 (FIG. 1), three electromagnets 4, 5 and 8 were fixed to a base 2 such that the projections of the magnets abut the three sides of a square. The center of the square represents the point above which the active region is found. A glass vial with a circular cross section 6 may be placed in the active region. The core of each electromagnet is oriented such that the magnetic field generated by it projects into the active region. The two electromagnets 4 and 5 opposite each other were connected to an electrical circuit which caused them to be alternately activated, with a period of about 6–40 sec.

Two embodiments of this example were fabricated, containing different means for alternating the activation of the two opposed magnets. In the first embodiment, the electronic circuit 10 (FIG. 1) comprised a source of DC current 12 passing through a contact switch 13, two RC timer circuits 14 and 15, each electrically connected to and having the capability of energizing an electromagnet, circuit 14 activating electromagnet 4 and circuit 15 activating electromagnet 5. The two circuits 14 and 15 were themselves connected electrically to each other by two 14A and 15A conductors, one conductor 14A connecting a first terminal T1 on circuit 14 with a fourth terminal T2 on circuit 15, and the second conductor 15A connecting a second terminal T2 on circuit 14 with a third terminal T3 on circuit 15, such that saturation of the RC timer portion of the first circuit caused the first circuit to be deactivated and the second circuit to be activated, and vice versa. Closing the contact switch 13 caused the alternation of the circuits to begin, and to continue until the switch 13 was opened. In this way alternately the first electromagnet 4 or the second electromagnet 5 was energized.

More specifically conductors 13A and 13B connect timer circuits 14 and 15 to DC source 12. Opening and closing switch 13 alternates current to the electromagnets 4 and 5.

EXAMPLE 2

Magnetic particles whose diameters were 40–60 $\mu$m, consisting of polystyrene enclosing core particles of magnetite (obtained from Polymer Laboratories Ltd., Church Stretten, Shropshire SY6 6AX, United Kingdom) were suspended in 1:1 dichloromethane:dimethyl-formamide and placed in the vial 6 in the active region of the device described in Example 1, incorporating the circuit of Scheme 1. Operation of the device caused to the particles to migrate alternately toward one wall of the vial or the opposite, i. e., toward that electromagnet of the pair that was activated at that point in time.

EXAMPLE 3

Figure 6:
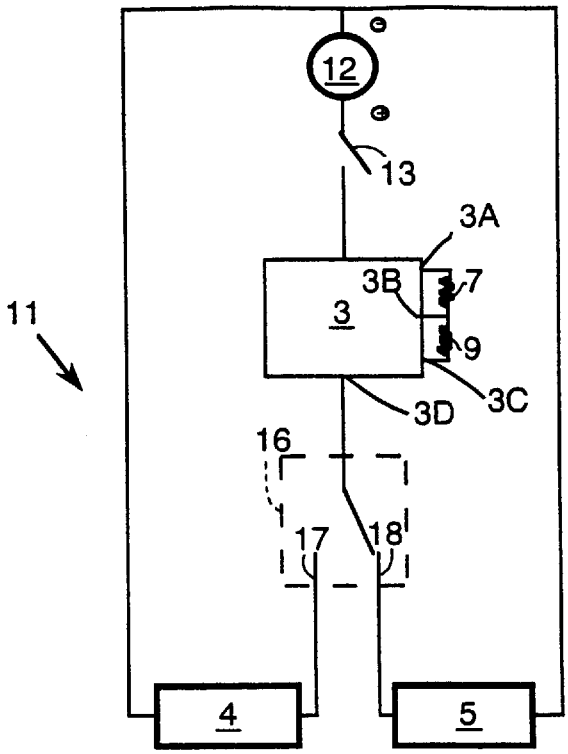

In the second embodiment the electronic circuit 11 (FIG. 6) for alternately energizing the two electromagnets comprised a source of DC current 12, a contact switch 13, an integrated circuit 3 which is a timer, two resistors 7 and 9, a relay 16 and the two electromagnets 4 and 5. The positive terminal of the DC source was electrically connected to a contact switch 13, and thence to the conventional integrated timer circuit 3. The two resistors 7 and 9 were electrically connected to the appropriate pins 3A, 3B, 3C of the timer 3 to cause the timer to cycle with a desired period, and the output pin 3D of the timer circuit 3 was electrically connected to the triggering mechanism of the relay 16. One of the alternate contacts 17 of the relay was electrically connected to electromagnet 4 and the second contact 18 was electrically connected to electromagnet 5. When the contact switch 13 was closed the timer circuit 3 caused the relay alternately to energize electromagnet 4 or electromagnet 5, thereby effecting cycling in a conventional manner.

EXAMPLE 4

In a preferred embodiment of the circuit of Example 3, in place of the two resistors 7 and 9, several pairs of resistors were electrically connected to the terminals of a three-pole rotary switch having several switchably selectable positions, with the three contacts of the switch electrically connected to the appropriate pins of the timer 3 to cause the timer to cycle with a given period. The pairs of resistors, which may be designated 7*a* and 9*a*, 7*b* and 9*b*, and so on, were chosen such that the period of the integrated circuit timer was switchably selectable over a range of values, by switchably engaging one pair or another of the resistors using the three-pole switch. In this way the period of alternation of the two electromagnets could be selected by operation of the three-pole switch.

EXAMPLE 5

Magnetic particles whose diameters were 40–60 $\mu$m, consisting of polystyrene enclosing core particles of magnetite (obtained from Polymer Laboratories Ltd.) were suspended in 1:1 dichloromethane:dimethylformamide and placed in the vial 6 in the active region of the device of Example 1 incorporating the circuit of Example 3 or 4. Operation of the device caused to the particles to migrate alternately toward one wall of the vial or the opposite, i. e., toward that electromagnet of the pair that was activated at that point in time.

EXAMPLE 6

Figure 7:
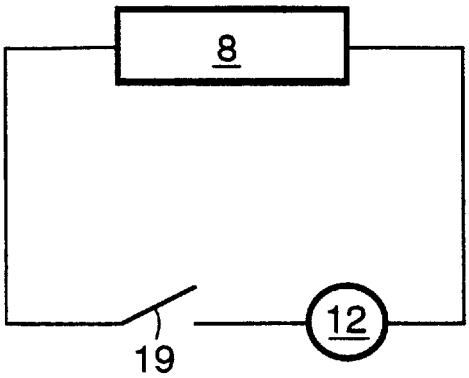

In this example (FIG. 1 and FIG. 7), the third electromagnet 8, positioned on the base 2 along a face of the square between the two opposed electromagnets 4 and 5, was switchably energized from a source of DC current 12 by closing a second contact switch 19. The second switch 19 was closed only if the contact switch 13 was open. When the second contact switch 19 was closed, the third electromagnet 8 was energized, constantly with time. This had the result that magnetic particles, suspended in a solvent and contained in a glass vial 6 in the active region, migrated toward and were sequestered at the wall of the vessel adjacent the third electromagnet 8. In this state of the suspension, the solvent could readily be drawn from the vial without entraining any particles.

EXAMPLE 7

Figure 2:
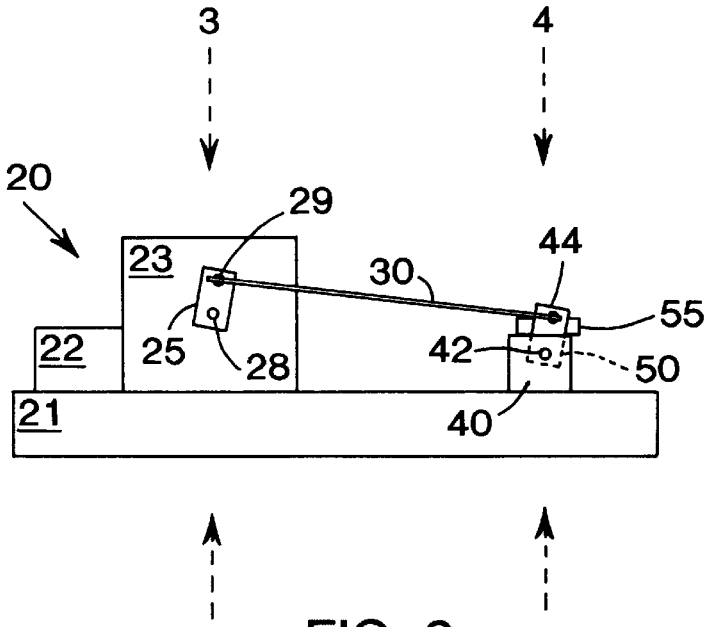
FIG. 2 is a side elevation of a mechanically-driven device for the alternation of magnetic field gradients about an active region.
Figure 3:
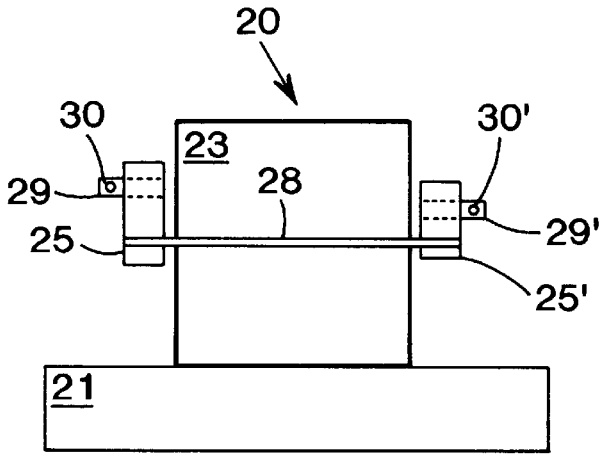
FIG. 3 is an end view elevation of the section marked 3 through the device of FIG. 2.
Figure 4:
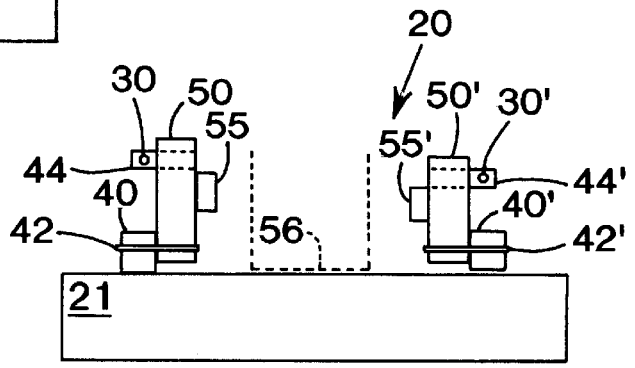
FIG. 4 is an end view elevation of the section marked 4 through the device of FIG. 2.
Figure 5:
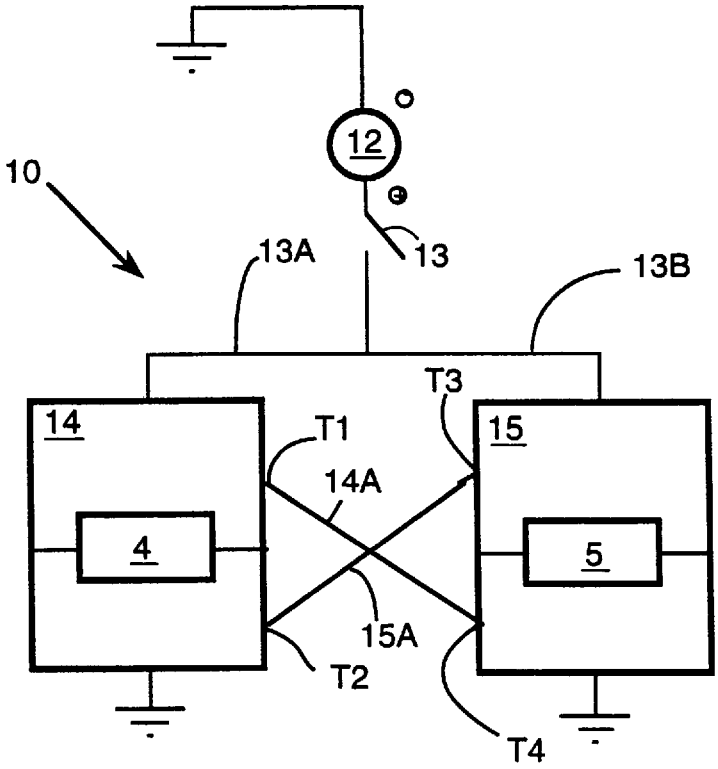
FIGS. 5–7 are top views of the electronic devices of the invention which produce magnetic field gradients.

A mechanical device 20 (FIGS. 2–4) for agitating magnetic particles in suspension was assembled on a base 21. A source of relatively slow rotary motion was provided by coupling the rotor shaft of an electric motor 22 to a reduction gear train housed in a casing 23. The output shaft 28 of the gear train extended beyond both external surfaces of the casing 23. To each end of the shaft 28 were firmly fixed cams 25 and 25'. Cam pivot pins 29 and 29', having freedom of rotational motion, were mounted at the second ends of the cams 25 and 25'. The cams were mounted out of phase with each other, but at an angle other than 180°. Also fixed to the base 21, some distance removed from the casing 23, were two pivot bases 40 and 40', between which the active region is found. Pivotable arms 50 and 50' were attached to each pivot base by means of pivot pins 42 and 42' near a first end of each pivotable arm. At the other end of the pivotable arms, second pivot pins 44 and 44', mounted with freedom of rotation with respect to the pivotable arms, were placed. Permanent magnets 55 and 55' were also fixed near the second ends of the pivotable arms 50 and 50', on the surfaces thereof facing the active region. Cam follower rods 30 and 30' were fixedly seated within the cam pivot pins 29 and 29', and within the second pivot pins 44 and 44'. The cam follower rods convert the circular motion of the cams 25 and 25' into reciprocating radial motion of the pivotable arms 50 and 50', the motion being approximately linear. When a contact switch controlling a source of power for the motor 120 was closed, the magnets 55 and 55' followed reciprocating trajectories about the active region. Since the cams 25 and 25' are mounted on the output shaft 28 neither in phase nor 180° out of phase, but rather at some intermediate phase angle, one or the other of the two magnets is always closer to the active region than the second magnet.

EXAMPLE 8

When a glass vial 56 (referring to FIG. 4) containing a suspension of polystyrene magnetic particles (Polymer Laboratories, Ltd.) in 1:1 dichloromethane:dimethylformamide was introduced into the active region, the particles migrated alternately toward one magnet, and then toward the other.

EXAMPLE 9

A suspension of magnetic particles comprising a core of magnetite and a shell of silica (obtained from Advanced Magnetics, Inc., Cambridge, Mass.) in a solvent was distributed into four micro vials made of glass. The set of four vials was placed in the active region of the device described in Example 3, in place of the vial 6 described therein. The contact switch 13 was closed. The particles in each of the four vials migrated alternately toward one electromagnet or the other as the circuit alternately activated the respective electromagnet.

EXAMPLE 10

The experiment described in Example 9 was repeated by placing the set of four vials in the active region of the device described in Example 7. When a contact switch controlling the motor 22 was closed, the particles in all four vials migrated alternately toward one magnet or the other as the cam follower rods alternately caused one or the other of the two magnets to approach the active region.

I claim:

1. An electronic device for generating a plurality of magnetic field gradients in differing orientations about an active region, such that only one of said magnetic field gradients is generated at any one time and different ones of the magnetic field gradients are alternately generated at differing times, comprising:

a) a chassis comprising electrical ground, and containing a point above which the active region is located;

b) a first electromagnet, a second electromagnet and a third electromagnet, each of said electromagnets having a base and two electrical leads, and mounted to said chassis, the bases of each of the electromagnets disposed about said point and essentially coplanar with a section through said active region such that the base of said first electromagnet is placed opposite the base of the second electromagnet on the chassis, and the base of the third electromagnet is placed between said bases of said first and said second electromagnets;

c) a source of current having a positive lead and a negative lead, mounted to said chassis, said negative lead electrically connected to said chassis and comprising electrical ground;

d) an electronic circuit mounted to said chassis, said electronic circuit being selectively, electronically connected and disconnected to the positive lead of said source of current and to ground, and further electrically connected in parallel to the leads of two of said electromagnets, said electronic circuit providing a means for alternately distributing said current to one or another of said two electromagnets at differing times;

e) means interposed between said positive lead of said source of current and said electronic circuit for selectively connecting and disconnecting said electronic circuit to said source of current; and f) means for selectively connecting said third electromagnet to said source of current, said selectively connecting means connecting said third electromagnet to said source of current only when said electronic circuit is disconnected from said source of current;

whereby said first and said second electromagnets are capable of effecting agitation of magnetic particles within a diamagnetic container placed in said active region and said third electromagnet is capable of immobilizing the magnetic particles.

2. An electronic device according to claim 1 wherein said electronic circuit for alternately distributing said current to said first electromagnet and to said second electromagnet comprises:

a) a first timing circuit having a first terminal and a second terminal b) said first electromagnet having both leads of which being energizably connected to said first timing circuit, c) a second timing circuit having a third terminal and a fourth terminal, and d) said second electromagnet having both leads of which being energizably connected to said second timing circuit; each of said timing circuits comprising 1. a lead electrically connected to the positive lead of said source of current, and
2. said means for selectively connecting and disconnecting said electronic circuit to said current source also fixing an interval of time during which said first and said second electromagnets are electrically energized by said timing circuit, thereby generating a magnetic field gradient in the active region; said first terminal electrically connected to said fourth terminal, and said second terminal electrically connected to said third terminal, such that said source of direct current alternately energizes said first electromagnet and said second electromagnet for said fixed interval of time.

3. An electronic device according to claim 1 wherein said electronic circuit for alternately distributing said current to said first electromagnet and to said second electromagnet comprises:

a) a timing circuit electrically connected across the leads of said source of current, comprising, 1. a first resistor and a second resistor, each resistor having two leads,
2. an integrated circuit serving as a timing element, and having a first, second and third timing pins, and an output pin, and
3. a relay electrically connected to and energizable by said output pin, comprising a contact electrically connected to the positive lead of said source of current, a first terminal, and a second terminal;

b) said first electromagnetic electrically connected to the first terminal of said relay and to the negative lead of said source of direct current; and c) said second electromagnet electrically connected to said second terminal of said relay and to the negative lead of said source of direct current;

a lead of said first resistor electrically connected to the first timing pin of said integrated circuit, another lead of said first resistor electrically connected to a lead of said second resistor and to the second timing pin of said integrated circuit, another lead of said second resistor electrically connected to the third timing pin of said integrated circuit, and the resistance values of said first resistor and said second resistor chosen such that said integrated circuit alternately energizes said relay, thereby causing the contact of said relay to make electrical contact either with said first terminal for an interval of time, thereby causing said source of current alternately to energize said first electromagnet for said interval of time or said second electromagnet for said interval of time.

* * * * *